United States Patent [19]

Wilkinson

[11] Patent Number: 5,058,535

[45] Date of Patent: Oct. 22, 1991

[54] PARALLEL FLOW COOLANT CIRCUIT FOR INTERNAL COMBUSTION AIRCRAFT ENGINES

[75] Inventor: Ronald E. Wilkinson, Mobile, Ala.

[73] Assignee: Teledyne Industries, Inc., Los Angeles, Calif.

[21] Appl. No.: 565,908

[22] Filed: Aug. 10, 1990

Related U.S. Application Data

[63] Continuation of Ser. No. 187,086, Apr. 28, 1988, abandoned.

[51] Int. Cl.[5] ..... F02B 75/18

[52] U.S. Cl. ..... 123/41.28; 123/56 AA; 123/56 BA

[58] Field of Search ..... 123/41.29, 41.74, 56 R, 123/56 AC, 56 AB, 56 AA, 56 BA, 56 BC, 59 R, 59 B, 41.28

[56] References Cited

U.S. PATENT DOCUMENTS

| | | | |
|---|---|---|---|
| 754,418 | 3/1904 | Brennan | 123/56 AC |
| 877,294 | 1/1908 | Chase et al. | 123/56 AC |
| 1,145,995 | 7/1915 | Johnson | 123/41.28 |
| 1,467,641 | 9/1923 | Johnson | 123/56 AC |
| 1,680,567 | 8/1928 | Pitzman | 123/41.28 |
| 1,875,580 | 9/1932 | Fisher | 123/41.28 |

FOREIGN PATENT DOCUMENTS

| | | | |
|---|---|---|---|
| 522103 | 3/1931 | Fed. Rep. of Germany | 123/41.29 |

*Primary Examiner*—Noah P. Kamen

*Attorney, Agent, or Firm*—Gifford, Groh, Sprinkle, Patmore and Anderson

[57] ABSTRACT

An improved cooling system for an internal combustion aircraft engine having horizontally opposed cylinders. The cooling system comprises a coolant design which delivers and removes coolant in a parallel circuit. The coolant flows from a common main coolant inlet line which branches into two secondary inlet lines. Each secondary inlet line has fitted thereto a number of cylinder inlet lines which branch off from the secondary inlet line to each deliver coolant to their respective cylinder. The heated coolant is removed via cylinder coolant outlet lines fitted to each cylinder. The cylinder outlet lines fluidly interconnect one of two secondary outlet lines. The secondary outlet lines combine into one main outlet line for delivery to a ram air cooled heat exchanger to begin the process again. To further assist in cooling, coolant enters the head portion of the cylinder and exits from the intermediate portion, thereby directing the coolest fluid first to the hottest portion of the cylinder.

7 Claims, 1 Drawing Sheet

PARALLEL FLOW COOLANT CIRCUIT FOR INTERNAL COMBUSTION AIRCRAFT ENGINES

This is a continuation of copending application U.S. Pat. Ser. No. 7/187/086 filed on Apr. 28, 1988, now abandoned.

BACKGROUND OF THE INVENTION

1. Field of the Invention

The present invention relates to cooling systems for internal combustion aircraft engines. More particularly, the present invention relates to a parallel flow coolant circuit for internal combustion aircraft engines having horizontally opposing piston cylinders.

II. Description of the Relevant Art

In an aircraft engine, as in all engines which experience energy loss in the form of heat, cooling is required to control such heat. This cooling is provided typically in the form of a liquid or a gas. When in gas form, bypassing air functions primarily as the coolant.

Beginning with the first flight of the Wright Brothers in 1903, liquid cooled piston engines have been used in aviation. The engine which powered that historic flight was a liquid cooled four cylinder, 200 cubic unit engine. Since those early days of flying the principle of employing a fluid to cool an aircraft engine has gone essentially unchanged.

Air cooled engines began to flourish in the 1930's in the form of the air cooled radial engine. The United States depended almost entirely upon the air cooled radial engine to power its military aircraft in World War II.

After 1945, both military and commercial aircraft began to shift reliance from piston driven engines to jet engines. On the other hand, the civilian light plane market grew in the postwar years, and the air cooled horizontally opposed piston engine expanded rapidly to become the mainstay of what has become known today as general aviation.

Yet in all its development, conventional horizontally opposed piston engines still rely largely upon air cooling. This is not because air cooling is more efficient than liquid cooling; just the opposite is true. However, because of certain disadvantages of liquid cooling, air cooling has been the method of choice.

One disadvantage of liquid cooling is the lack of reliability of the coolant plumbing system. However, modern technology including new materials and a better understanding of stress and thermal expansion has largely overcome this disadvantage.

Another important disadvantage of liquid cooling is the uneven cooling of the cylinders and pistons by the liquid coolant. This uneven cooling results in temperature variation from one cylinder and its component parts to the next. Such variations commonly lead to equipment failure.

The main cause of this uneven cooling is the construction of the cooling manifold which advances coolant from one cylinder to the next in a series, thereby resulting in undesirable temperature variation from one cylinder to the next. According to this known system, an extremely wide temperature difference exists between the first cylinder to be cooled and the last.

SUMMARY OF THE INVENTION

The present invention provides a cooling system for an aircraft engine having horizontally opposed cylinders which overcomes the above-mentioned disadvantages of the previously known devices.

In brief, the cooling system of the present invention comprises a coolant inlet manifold which delivers coolant to the head portion of a coolant jacket of a piston cylinder and a coolant outlet manifold which removes coolant from the lower portion of the coolant jacket after circulation of the coolant therethrough.

According to this design, the lowest temperature coolant first cools the hotter head portion before circulating to the relatively cooler lower portion which substantially surrounds the piston.

The inlet and outlet manifolds each include a main inlet line which branches into two secondary lines. Each of the secondary lines has a number of individual lines which branch off therefrom. Each individual line fluidly interconnects with the coolant jacket of a cylinder.

According to this array, the coolant is delivered in parallel, rather than in series, as is conventionally known. Cooling in parallel virtually eliminates temperature variations, as cooled liquid of the same temperature is introduced into each cylinder, and is removed by a separate manifold for recirculation.

Furthermore, by using a parallel rather than a series flow system, the pressure drop through the engine is minimized This loss has been measured at only 1–2 PSI. Accordingly, pump power demand is reduced as compared to a series flow system.

The parallel flow coolant circuit supplies coolant to and from each cylinder using a tubular manifold. High integrity aerospace type fluid connectors fit the manifolds to the cylinder jackets. Other connectors of this type are used at intercylinder joints.

BRIEF DESCRIPTION OF THE DRAWINGS

A better understanding of the present invention will be had upon reference to the following detailed description when read in conjunction with the accompanying drawings wherein like reference characters refer to like parts throughout the views, and in which.

DETAILED DESCRIPTION OF THE PREFERRED EMBODIMENTS OF THE PRESENT INVENTION

Figure 1:
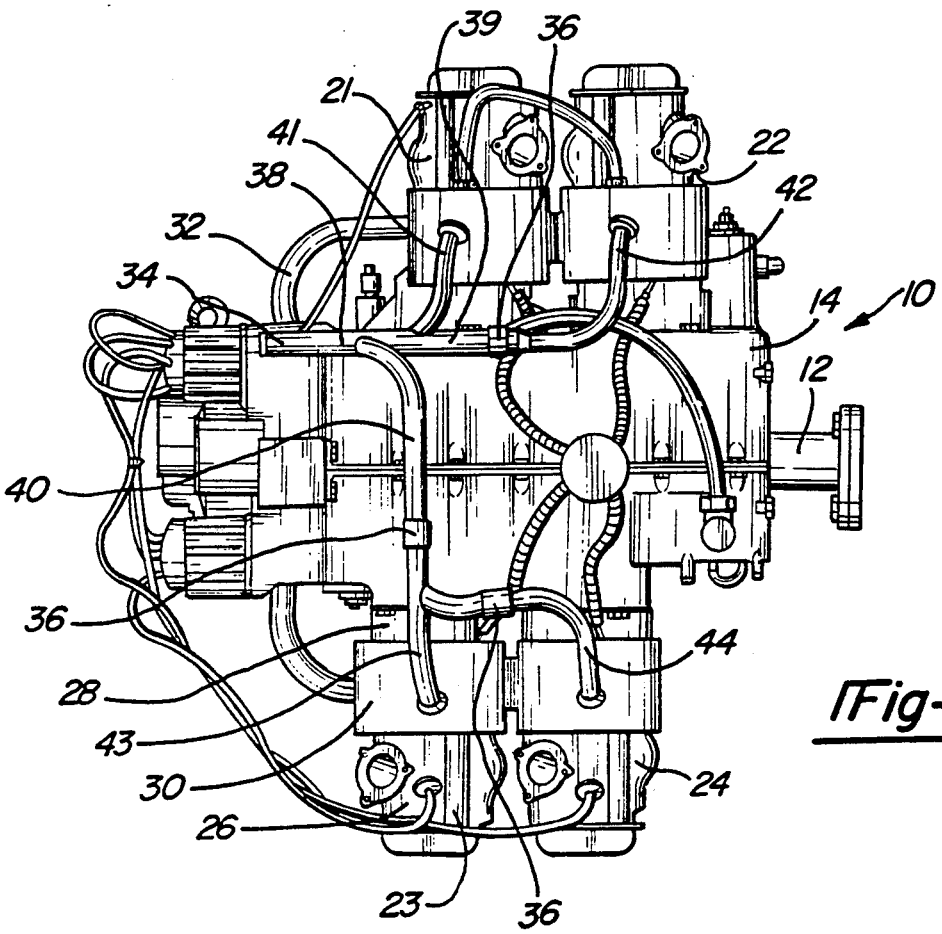
FIG. 1 is a top plan view illustrating a preferred embodiment of the present invention.
Figure 2:
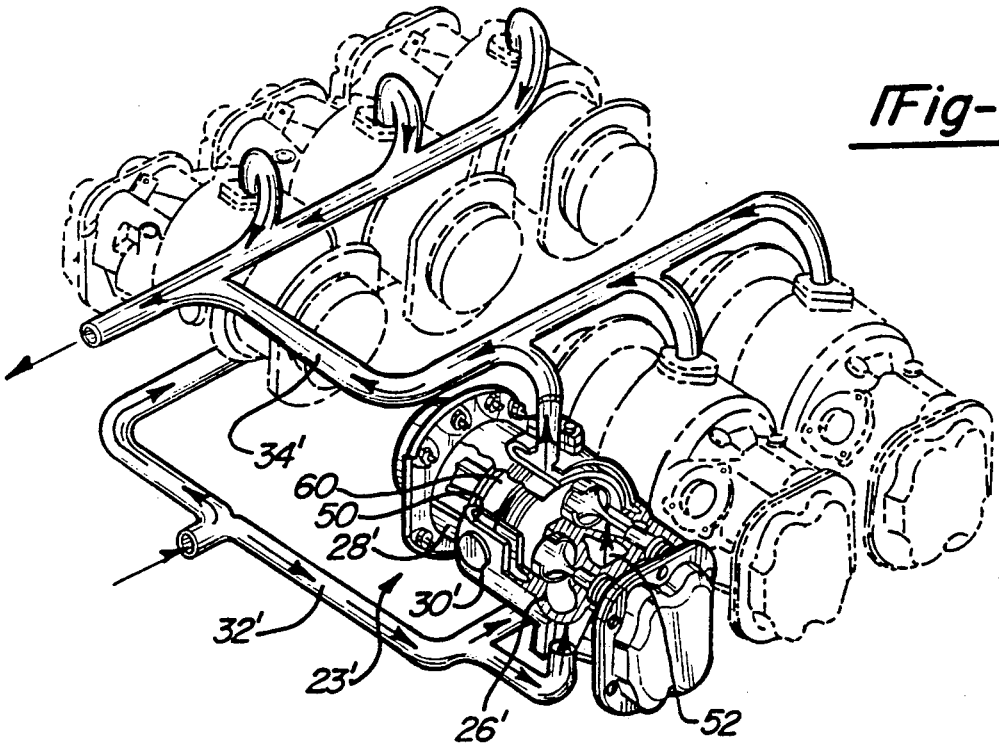
FIG. 2 is a partial perspective view in partial shadow lines illustrating an alternate embodiment of the present invention.

FIGS. 1 and 2 show preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, there is shown a top plan view of an engine having a partial view cf a cooling circuit according to the present invention. The engine is generally indicated by 10. The engine 10 is largely conventional and includes a crankshaft 12 and a crankcase 14.

The engine 10 is of the type having horizontally opposed piston cylinders, a configuration conventionally known in the aircraft industry. Although such inventions may include two, four, six, eight or more cylinders, according to the conventional design even numbers of cylinders are opposingly provided. As illustrated in the engine 10, four cylinders are shown, 21, 22, 23, 24. Each of the cylinders 21, 22, 23, 24 includes a cylinder head portion 26 (as shown, by way of example, on the cylinder 23) and a lower uncooled cylinder barrel portion 28 and an intermediate cooled cylinder barrel portion 30. Internally provided within the cylinder head portion 26 and the intermediate cooled cylinder barrel portion 30 is a cooling jacket (not shown in FIG. 1 but visible in FIG. 2; see related discussion below).

The cooling circuit according to the present invention includes essentially two parts, a coolant inlet manifold generally indicated by 32 and a coolant outlet manifold generally indicated by 34. While the coolant circuit as illustrated includes the inlet manifold 32 as being situated below the plane of the engine 10 and the outlet manifold 34 as being situated above the plane, it must be understood that this order may be reversed.

While the inlet manifold 32 is only partly visible in FIG. 1, the outlet manifold 34 is fully shown. The construction of the inlet manifold 32 may be more readily seen and understood with reference to FIG. 2.

In either of the inlet manifold 32 or the outlet manifold 34, the manifolds are of tubular aluminum alloy construction. A number of linear connectors 36 are provided to simplify component fabrication and to enhance flexibility. Consistent with aviation standards that apply to aircraft fuel and lubrication systems, all connectors and seals in the cooling system are high integrity designs that evolved from aerospace experience in developing reliable fluid handling methods.

With reference to the coolant outlet manifold 34 as shown in FIG. 1, the manifold 34 includes a main outlet line 38, a first secondary line 39 and a second secondary line 40.

Branching off from the first secondary line 39 and fluidly interconnecting with the coolant jacket of the cylinder 21 is a cylinder line 41. The next line to branch off of the first secondary line 39 is a cylinder line 42 which fluidly interconnects with the coolant jacket of the cylinder 22.

Referring now to the second secondary line 40, the first line to branch off therefrom is the cylinder line 43 which fluidly interconnects with the coolant jacket of the cylinder 23. The next line to branch off of the second secondary line 40 is a cylinder line 44 which fluidly interconnects with the coolant jacket of the cylinder 24.

The coolant inlet manifold 32 which is only partially visible embodies the same parallel circuit configuration as has been described with respect to the coolant outlet manifold 34.

This parallel coolant circuit provides more uniform cylinder to cylinder temperature distribution because each cylinder is delivered coolant having the same approximate temperature and the temperature of the coolant being eliminated from each cylinder is approximately the same.

It should be understood that most automotive cooling systems utilize a series coolant flow circuit. Typical of these systems, coolant enters the block and flows first around the base of each cylinder before being directed to the cylinder head area. This approach tends to over cool the cooler bottom end and under cool the hotter head area with the cylinder heads increasing in temperature along the flow path as the cooled temperature rises. Conversely, in a cooling system as is disclosed herein where the flow of coolant is first directed to the head area before circulating around the cylinder barrel section, a more uniform cylinder assembly temperature profile is possible.

Therefore, according to the present invention the coolant is delivered into the coolant jacket defined in the cylinder head portion 26 and is circulated down through the jacket to the intermediate cooled cylinder barrel portion 30. This system is more clearly seen with respect to FIG. 2.

Accordingly, with reference to FIG. 2, a partial perspective view of another preferred embodiment of the present invention is illustrated. Unlike the engine 10 illustrated in FIG. 1, there are six cylinders indicated. The parallel circuit of the coolant flow is identical to that of the cooling system of FIG. 1, except for the additional inlet and outlet branches to the two additional cylinders. The inlet manifold is generally indicated as 32' and the outlet manifold is generally indicated as 34'.

With particular reference to the cylinder 23' shown in partial cut away, the three portions of the cylinders described above with respect to FIG. 1 are more clearly understood.

The lower uncooled cylinder barrel portion 28' is a sleeve within which a piston 60 reciprocates. Fitted thereover is the intermediate cooled cylinder barrel portion 30' which includes an intermediate cooled cylinder jacket 50 being peripherally provided. The cooled cylinder jacket 50 fluidly interconnects a head jacket 52 defined within the cylinder head portion 26'.

The arrows indicate the approximate flow of the coolant, thereby fully illustrating the cooling system. An engine driven pump (not shown) supplies coolant under pressure to the coolant inlet manifold 32'. From the coolant inlet manifold 32' the coolant enters the head jacket 52, and flows therefrom into the cylinder jacket 50. After circulation within the jacket 50, the heated coolant exits the jacket 50 and enters the coolant outlet manifold 34'. From the outlet manifold 34' the heated coolant is directed to a ram air cooled heat exchanger for cooling and recirculation.

Having set forth the present invention and what is considered to be the best embodiments thereof, it will be understood that changes may be made from the specific embodiments set forth without departing from the spirit of the invention exceeding the scope thereof as defined in the following claims.

I claim:

1. A reciprocating internal combustion engine comprising:

at least two horizontally opposing cylinders, each cylinder having a cylinder head and an engine block end;

an engine block;

a piston reciprocally slidably mounted in each of said cylinders delivering power through said engine block;

a coolant jacket radially provided about each of said cylinders defining the same coolant passage, said engine block end such that said coolant jacket does not extend over said cylinder head, thereby saving weight for each cylinder from a coolant inlet aperture in said jacket adjacent the head end of said cylinder to a coolant outlet aperture in said jacket at said engine block end of said cylinder;

means for delivering the same amount of coolant to each of said inlet apertures and for eliminating said coolant from said outlet apertures;

said means including an inlet manifold and an outlet manifold;

said inlet manifold having an inlet line of the same capacity to each of said inlet apertures in parallel flow; and said outlet manifold having an outlet line to each of said outlet apertures in parallel flow;

whereby coolant is delivered through each jacket in parallel flow to provide engine cooling of each cylinder with the lowest temperature coolant delivered to the hotter head end of the cylinder and removed at the cooler engine block end of the cylinder.

2. A reciprocating internal combustion engine according to claim 1 wherein said inlet and outlet manifolds are composed of tubular aluminum.

3. A reciprocating internal combustion engine according to claim 2 wherein said cylinders number four.

4. A reciprocating internal combustion engine according to claim 3 wherein said pistons are situated with a first one of said cylinders horizontally opposing a second one of said cylinders and a third one of said cylinders opposing a fourth one of said cylinders; and said first and third ones of said cylinders being situated next to one another and said second and fourth ones of said cylinders being situated next to one another.

5. A reciprocating internal combustion engine according to claim 4 wherein said inlet manifold comprises:

a main inlet line;

said main inlet line branching to a first secondary inlet line and a second secondary inlet line of the same capacity as said first secondary inlet line;

said first secondary inlet line having branching therefrom to two cylinder inlet lines of the same capacity;

the first of said two cylinder inlet lines to branch from said first secondary inlet line being fluidly interconnected with the inlet aperture in the jacket of said first cylinder;

the second of said two cylinder inlet lines to branch from said first secondary inlet line being fluidly interconnected with the inlet aperture in the jacket of said third cylinder;

said second secondary inlet line having branching therefrom to two cylinder inlet lines of the same capacity;

the first of said two cylinder inlet lines to branch from said first secondary inlet line being fluidly interconnected with the inlet aperture in the jacket of said second cylinder; and the second of said two cylinder inlet lines to branch from said second secondary inlet line being fluidly interconnected with the inlet aperture in the jacket of said fourth cylinder;

6. A reciprocating internal combustion engine according to claim 5 wherein said outlet manifold comprises:

a main outlet line;

said main outlet line branching to a first secondary outlet line and a second secondary outlet line;

said first secondary outlet line having branching therefrom to two cylinder outlet lines;

the first of said two cylinder outlet lines to branch from said first secondary outlet line being fluidly interconnected with the outlet aperture in the jacket of said first cylinder;

the second of said two cylinder outlet lines to branch from said first secondary outlet line being fluidly interconnected with the outlet aperture in the jacket of said third cylinder;

said second secondary outlet line having branching therefrom to two cylinder outlet lines;

the first of said two cylinder outlet lines to branch from said second secondary outlet line being fluidly interconnected with the outlet aperture in the jacket of said second cylinder and the second of said two cylinder outlet lines to branch from said second secondary outlet line being fluidly interconnected with the outlet aperture in the jacket of said fourth cylinder;

7. A reciprocating combustion engine according to claim 2 wherein said cylinders number six.

* * * * *